United States Patent [19]

Schröer et al.

[11] Patent Number: 4,673,729

[45] Date of Patent: Jun. 16, 1987

[54] PAPER AUXILIARY FROM CONDENSATION PRODUCT OF ALIPHATIC POLYOL-ETHER-AMINE AND COMPOUND POLYFUNCTIONAL TOWARD AMINO GROUPS

[75] Inventors: Wolf-Dieter Schröer; Janos Muszik; Günther Cramm, all of Leverkusen; Otto Benn, Bergisch Gladbach, all of Fed. Rep. of Germany

[73] Assignee: Bayer Aktiengesellschaft, Leverkusen, Fed. Rep. of Germany

[21] Appl. No.: 717,410

[22] Filed: Mar. 29, 1985

[30] Foreign Application Priority Data

Apr. 11, 1984 [DE] Fed. Rep. of Germany ..... 3413567

[51] Int. Cl.[4] ..... C08G 61/00; D21H 3/58

[52] U.S. Cl. ..... 528/397; 524/612; 528/324; 528/332; 528/335; 528/342; 528/391; 528/392; 528/405; 528/421; 528/422

[58] Field of Search ..... 528/397, 405, 421, 422, 528/324, 332, 342, 335, 391, 392; 524/612

[56] References Cited

U.S. PATENT DOCUMENTS

| | | | |
|---|---|---|---|
| 3,251,882 | 5/1966 | Kirkpatrick et al. | 260/584 |
| 3,347,803 | 10/1967 | Frotscher et al. | 260/2 |
| 4,066,494 | 1/1978 | Scharf et al. | 162/164 |
| 4,267,059 | 5/1981 | Behn et al. | 210/736 |
| 4,281,199 | 7/1981 | Langdon | 564/475 |
| 4,328,142 | 5/1982 | Hertel et al. | 523/417 |
| 4,450,045 | 5/1984 | Hertel et al. | 162/164.3 |

FOREIGN PATENT DOCUMENTS 1509967 5/1978 United Kingdom .

*Primary Examiner*—Harold D. Anderson
*Attorney, Agent, or Firm*—Sprung Horn Kramer & Woods

[57] ABSTRACT

The present invention relates to agents for increasing the retention of fibres, fillers and pigments and for accelerating drainage in papermaking, and as flocculating agents in the working up of effluents from papermaking by filtration, sedimentation and flotation. They are characterized in that they contain, as active components, one or more nitrogen-containing condensation products which can be obtained by reacting (A) aliphatic polyol-ether-amines which are free from halogen groups, contain cohesive polyether segments and carry no amino groups within these segments, with (B) compounds which are polyfunctional towards amino groups, optionally in the presence of (C) polyaminopolyamides and/or (D) polyalkylenepolyamines, component (B) being employed in an amount such that water-soluble polycondensates which have a viscosity of 100 to 1,000 mPa.s at 25° C. in 25% strength aqueous solution are formed.

7 Claims, No Drawings

PAPER AUXILIARY FROM CONDENSATION PRODUCT OF ALIPHATIC POLYOL-ETHER-AMINE AND COMPOUND POLYFUNCTIONAL TOWARD AMINO GROUPS

The present invention relates to new agents for increasing the retention of fibres, fillers and pigments and for accelerating drainage in papermaking, and as flocculating agents in the working up of effluents from papermaking by filtration, sedimentation and flotation.

German OffenLegungsschrift No. 2,726,651 describes condensation products which are obtained by reaction of chloropolyethylene glycol ether-amines with polyamide-amines and subsequent crosslinking with polyfunctional compounds. The chloropolyethylene glycol ether-amines are prepared by addition, catalysed by boron trifluorideetherate, of 2 moles of epichlorohydrin onto 1 mole of polyethylene glycol ether and subsequent condensation of one side of the chain with particular amines.

The use of an ambivalent polyether unit, that is to say a compound which can react both with amines and with crosslinking agents, and also with itself, leads to non-uniform products.

Polycondensates of (a) epichlorohydrin and (b) a precondensate of a polyalkylenepolyamine and a polyoxyalkylene glycol chloride with a molecular weight of 100–800 are known from U.S. Pat. No. 3,251,882, but in this case they are used for a different purpose, that is to say for breaking emulsions based on petroleum/water.

German Offenlegungsschrift No. 2,434,816 describes condensates of polyamide-amines and polyalkylene oxide derivatives which are reacted with at least equivalent amounts of epichlorohydrin on the terminal OH groups. The condensation is carried out at 20° to 100° C. in aqueous solution, products with a satisfactory action being obtained, in particular, if ethyleneimine is grafted onto the polyamide-amines.

Closing of the water circulations in papermaking leads to an enrichment of troublesome substances in the system, which have an adverse influence on the action of the paper auxiliaries, and in particular also of the polyamide-amines mentioned.

In particular, the troublesome substances form deposits and impair retention.

The object of the invention was therefore to provide effective auxiliaries for papermaking which are insensitive towards troublesome substances, without having to graft monomeric ethyleneimine onto any component.

It has now been found that agents with an excellent capacity for increasing the retention of fibres, fillers and pigments and for accelerating drainage in papermaking, and as flocculating agents in the working up of effluents from papermaking by filtration, sedimentation and flotation are obtained by a process in which one or more nitrogen-containing condensation products which can be obtained by reacting (A) aliphatic polyol-ether-amines which are free from halogen groups, contain cohesive poly-ether segments and carry no amino groups within these segments, with (B) compounds which are polyfunctional towards amino groups, optionally in the presence of (C) polyaminopolyamides and/or (D) polyalkylenepolyamines, are used as the active components, component (B) being employed in an amount such that water-soluble polycondensates which have a viscosity of 100 to 1,000 mPa.s at 25° C. in 25 percent strength aqueous solution are formed.

Agents which have preferably been employed are those which contain, as the active component, reaction products of aliphatic polyether-amines which are free from halogen groups and are obtained by reaction of (a) ω-polychloropolyol-ethers with a functionality of 1.90–3.10 moles of Cl/mole and (b) polyalkylenepolyamines of the general formula $$H_2N-[CH_2-\underset{\underset{R}{|}}{CH}-(CH_2)_y-NH]_x-H$$

in which

R denotes H or $CH_3$, the indices y are identical or different and denote the number 0 or by 1 and x denotes a number from 1 to 50, and/or (c) polyalkylenepolyamines of the general formula $$H-\left[NH-CH_2-\underset{\underset{R^1}{|}}{CH}-(CH_2)_x\right]_m$$

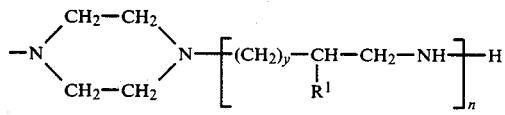

in which $R^1$=H or $CH_3$, the indices x and y are identical or different and denote the number 0 or 1, m denotes a number from 1 to 50 and n denotes a number from 0 to 50, and/or (d) polyalkylenepolyamines of the general formula $$Y-[(CH_2-\underset{\underset{R^3}{|}}{CH}-CH_2-NH)_p-H]_q$$

in which

Y=oxygen, sulphur or the radical, which is at least divalent, of an aliphatic, cycloaliphatic, araliphatic or aromatic compound containing hydroxyl and/or sulphhydryl groups, $R^3$=hydrogen or $CH_3$, p=an integer ≧1, preferably 1–3, and q=an integer ≧2, preferably 2–4, with (B) compounds which are polyfunctional towards amino groups, optionally in the presence of (C) polyaminopolyamides which have been obtained from 1 molar portion of a dicarboxylic acid with 4 to 10 carbon atoms and 0.8 to 1.4 molar portions of a polyalkylene polyamine with 3 to 10 alkyleneimine units, and/or (D) polyalkylenepolyamines of the general formula $$H_2N-[CH_2-\underset{\underset{R}{|}}{CH}-(CH_2)_y-NH]_x-H$$

in which

R denotes H or $CH_3$, the indices y are identical or different and denote the number 0 or 1 and x denotes a number from 4 to 2,500, or mixtures of these polyalkylenepolyimines with amines of the same general formula, but in which x denotes a number from 1 to 3, component B being employed in an amount such that water-soluble polycondensates which have a viscosity of 100 to 1,000 mPa.s at 25° C. in 25 percent strength aqueous solution are formed.

Addition compounds of polyol-ethers and epichlorohydrin which have a functionality of 1.90–3.10 moles of Cl/mole are employed as the preferred ω-polychloropolyolethers (a).

The invention furthermore relates to nitrogen-containing condensation products which are obtained by reacting ($A_1$) aliphatic polyol-ether-amines which are free from halogen groups and are derived from polyols which have an average molecular weight of 400 to 1,000 and contain at least three OH groups, with ($B_1$) compounds which are polyfunctional towards amino groups, optionally in the presence of ($C_1$) polyaminopolyamides and/or ($D_1$) polyalkylenepolyamines, component $B_1$ being employed in an amount such that water-soluble polycondensates which have a viscosity of 100 to 1,000 mPa.s at 25° C. in 25 percent strength aqueous solution are formed.

The invention furthermore relates to a process for the preparation of these water-soluble polycondensates and their use as agents for increasing the retention of fibres, fillers and pigments and for accelerating drainage in papermaking, and for working up effluents from paper machines by filtration, sedimentation and flotation.

The aliphatic polyol-ether-amines are obtained by reacting ω-chloropolyol-ethers with polyalkylenepolyamines in the absence of solvents, preferably in the presence of small amounts of water (for example residual water from industrial polyalkylenepolyamines), at a temperature from 80° to 200° C., preferably 100° to 180° C. 30 to 50% of the ω-chloropolyol-ether is here advantageously brought to the reaction temperature together with all of the amines, and only then is the residual amount of ω-chloropolyol-ether added and the reaction brought to completion. It is of course also possible to add all of the ω-chloropolyol-ether to the amine mixture only when the reaction temperature has been reached. A further possible reaction procedure comprises mixing all of the ω-chloropolyol-ether and amine at a temperature at which the reaction time is long in comparison with the mixing time (that is to say temperatures of preferably below 90° C.), and then bringing the mixture to the reaction temperature. When the reaction has ended, a sufficient amount of water is added to the reaction product to form a homogeneous solution. 20–80% strength aqueous solutions of the polyol-ether-amines are obtained in this manner.

The ratio of ω-chloropolyol-ether to polyalkylenepolyamines should be chosen so that uniform products are obtained. At least almost equimolar amounts of polyalkylenepolyamine are required for this. The excess of amine in moles is related to the content of reactive chlorine groups in the ω-chloropolyol-ether. Polyether-amines according to the invention are obtained when 0.95 to 1.30 moles of polyalkylenepolyamine are empolyed per mole of chlorine in the ω-chloropolyol-ether. Preferably, 1.05 to 1.20 moles of polyalkylenepolyamine are employed per mole of chlorine in the ω-chloropolyol-ether. However, it is also entirely possible to carry out the condensation reaction in the presence of a larger excess of polyalkylenepolyamine. As a rule, it is not necessary to remove the unreacted polyalkylenepolyamine, since this is incorporated into the polycondensate during the subsequent reaction with the crosslinking agents.

The preparation of ω-chloropolyol-ethers is known. These compounds can be obtained by reacting polyethylene glycols with phosgene or thionyl chloride in accordance with German Offenlegungsschrift No. 2,934,854. German Offenlegungsschrift No. 2,434,816, for example, describes another route. Polyethylene glycols are reacted with epichlorohydrin at 40° to 100° C. with the addition of Lewis acids as catalysts, such as, for example, tin(IV) chloride, zinc chloride, iron(III) chloride, aluminium chloride or boron trifluoride or addition compounds thereof on electron donors, such as, for example, water, ethers and carboxylic acids, addition compounds of 100 parts of polyethylene glycol and 0.05 to 10 parts of boron trifluoride being preferred. The molar ratio of OH groups to epichlorohydrin is chosen so that polyglycol addition compounds with 1.90 to 3.10 moles of reactive chlorine atoms per mole of addition compound are obtained. A functionality of 2.10–2.80 moles of Cl/mole is preferred. The functionality in moles of Cl/mole is determined by quantitative analysis.

The polyalkylene-polyols which can be used are essentially built up from ethylene oxide units. Nevertheless, it is also possible for up to 25 mole %, but preferably only up to 10 mole %, of propylene oxide to be copolymerised in randomly or in block form. The average molecular weights of the polyglycols mentioned is 200 to 1,200, in particular 400 to 1,000.

They are obtained in a known manner (see, for example, Houben-Weyl), by reacting polyols with the alkylene oxides mentioned. Polyols which are suitable in the context of the invention contain at least two OH groups per molecule, but preferably 3 OH groups, and are derived from trimethylolpropane or glycerol.

Polyalkylenepolyamines of the formula $$H_2N-[CH_2-\underset{\underset{R}{|}}{CH}-(CH_2)_y-NH]_x-H,$$

in which

R denotes H or $CH_3$, the indices y are identical or different and denote the number 0 or 1 and x denotes 1 to 3 or 4 to 50, which may be mentioned are, above all, the polyethylenepolyamines, in which y represents zero, for example ethylenediamine, propylene-1,2-diamine, diethylenetriamine, dipropylenetriamine, triethylenetetramine, tripropylenetetramine, tetraethylenepentamine, tetrapropylenepentamine, pentaethylenehexamine, pentapropylenehexamine, hexaethyleneheptamine, heptaethyleneoctamine, heptapropyleneoctamine and their mixtures, and polyethylenepolyamines which additionally also contain one or more piperazine rings, such as aminoethylpiperazine, pentaethylenepentamine, octaethyleneheptamine and mixtures thereof, but in particular (a) the polyethylenepolyamine mixture which is obtained in the batchwise (for example Houben-Weyl, 4th edition, XI/1, page 44) or continuous (for example in British Patent Specification Nos. 1,832,534 and 2,049,467) reaction of 1 mole of 1,2-dichloroethane with aqueous ammonia (6–30 moles), if appropriate in the presence of added ethylenediamine or diethylenetriamine (U.S. Pat. Nos. 2,769,841 and 3,484,488), and which contains considerable amounts of tetraethylenepentamine, pentaethylenehexamine, hexaethylenehexamine, hexaethyleneheptamine, heptaethyleneheptamine and higher amines, and, above all, (b) the polyethylenepolyamine mixtures, which remain after distilling off ethylenediamine, and if appropriate also diethylenetriamine and triethylenetetramine, from the base mixture prepared according to (a), (c) the polyfunctional oligomeric amines which can be prepared by condensation of 1,2-dichloroethane with the abovementioned polyethylenepolyamines, individually or as a mixture, and which have an average molecular weight of 200 to 2,000, in particular 500 to 1,500, and (d) the polyfunctional amines which can be obtained by polymerisation of 1,2-alkyleneimines and have an average molecular weight of 200 to 2,000, in particular 500 to 1,500.

Other polyalkylenepolyamines of the abovementioned formula which may also be mentioned are: (e) pure polypropylenepolyamines and mixtures thereof, (f) mixed polyethylenepolypropylenepolyamines and mixtures thereof, above all those which are obtained via single or several reactions between ethylenediamine and/or propylene-1,3-diamine and acrylonitrile, with subsequent hydrogenation in each case, for example polyfunctional amines of the formula $$H_2N-[CH_2-CH_2-CH_2-NH]_x-H$$

wherein x denotes an integer from 1 to 10, and those of the formula $$H[NH-CH_2-CH_2-CH_2]_m-NH-CH_2-CH_2-NH-[CH_2-CH_2-CH_2-NH]_nH$$

wherein m denotes an integer from 1 to 5 and n denotes an integer from 0 to 5, and also (g) the polyfunctional amines which can be prepared by condensation of 1,2-dichloroethane with the polyalkylenepolyamines mentioned under (e) and (f) and have an average molecular weight of 200 to 2,000, in particular 500 to 1,500.

It is frequently advantageous for the polyalkylenepolyamines predominantly to consist of polyamines of the general formula

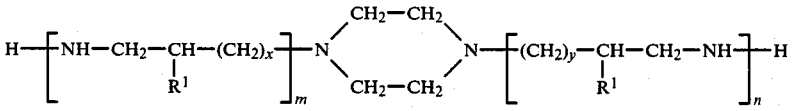

wherein $R^1$ denotes H or $CH_3$;

the indices x and y are identical or different and denote the number 0 or 1;

m denotes a number from 1 to 50 and n denotes a number from 0 to 50.

In some cases it is advantageous to employ di-, tri-, tetra-, penta- or hexa-amines of the following formula:

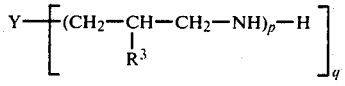

in which

Y represents oxygen, sulphur or the radical, which is at least divalent, of an aliphatic, cycloaliphatic, araliphatic or aromatic compound containing hydroxyl and/or sulphhydryl groups, $R^3$ denotes hydrogen or the methyl group, p is an integer of at least 1, preferably 1–3, and q represents an integer of at least 2, preferably 2–4.

Examples of representatives of these polyamines are bis-(3-amino-propyl) ether, bis-(3-aminopropyl) sulphide, ethylene glycol bis-(3-amino-propyl) ether, dithioethylene glycol bis-(3-aminopropyl) ether, neopentylene glycol bis-(3-amino-propyl) ether, hexahydro-p-xylylene glycol bis-(3-amino-propyl) ether and hydroquinone bis-(3-amino-propyl) ether, and amines of the formula

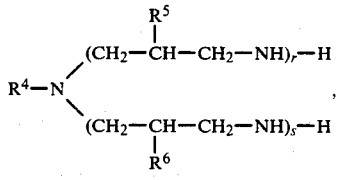

in which $R^4$ represents a $C_1$-$C_{18}$-alkyl radical which is optionally substituted by an amino or hydroxyl group, $R^5$ and $R^6$ independently of one another represent hydrogen or a methyl group and r and s are a number from 1 to 20, preferably 1 to 5.

Examples of representatives of these polyamines are ethyl-bis-(3-amino-propyl)-amine, 2-hydroxyethyl-bis-(3-amino-propyl)-amine, n-butyl-bis-(3-amino-propyl)-amine, tris-(3-amino-propyl)-amine and, above all, methyl-bis-(3-amino-propyl)-amine.

A base mixture which consists of at least 60 mole % of aminoethylpiperazine, at most 20 mole % of diethylenetriamine and of others of the abovementioned amines, as the remainder, is especially preferred.

Aliphatic polyether-amines, which are free from halogen groups, according to the invention can be obtained in another manner. German Auslegeschrift No. 1,215,373 describes, for example, reductive amination of polyglycol ethers. The reaction of polyalkylenepolyols with acrylonitrile and subsequent hydrogenation, for example, is also a route to the polyether-amines according to the invention.

Compounds which are polyfunctional towards amino groups and are particularly suitable for the preparation of the polycondensates according to the invention are those polyfunctional compounds which are capable of reacting completely with the amino groups contained in the basic polyamides in aqueous solution at pH values above 6, preferably above 8.

Examples which may be mentioned of compounds which are polyfunctional towards amino groups are: bifunctional compounds, such as α,ω-alkyldihalides, for example, in particular, 1,2-dichloroethane, 1,2-dibromoethane, 1,2-dichloropropane, 1,3-dichloropropane and 1,6-dichlorohexane; ω,ω'-dihalogeno-ethers, for example 2,2'-dichlorodiethyl ether, bis-(β-chloroisopropyl) ether and bis-(4-chloro-butyl) ether; halogenohydrins and epihalogenohydrins, for example epichlorohydrin, 1,3-dichloropropan2-ol, bis-(3-chloro-2-hydroxypropyl) ether and 1,4-dichloro2,3-epoxybutane; bis-epoxy compounds, for example, 1,2,3,4-diepoxybutane, diglycidyl ether and ethane-1,2-bisglycidyl ether; ω-halogenocarboxylic acid halides, for example chloroacetyl chloride, 2-chloropropionyl chloride, 3-chloropropionyl chloride and 3-bromopropionyl bromide; vinyl compounds, for example divinyl ether, divinyl sulphone and methylenebisacrylamide; and furthermore 4-chloromethyl-1,3-dioxalan-2-one and 2-chloroethylchloroformic acid esters, and also chloroformic acid esters, 3-chloro-2-hydroxypropyl ethers and glycidyl ethers of polyalkylene oxides, for example polyethylene oxides, and of reaction products of 1–50 moles of alkylene oxides, such as ethylene oxide and/or propylene oxide, with 1 mole of dibasic or polybasic polyols or of another compound which contains at least two active hydrogen atoms; and trifunctional compounds, such as 1,3,5-triacryloylhexahydro-s-triazine, as well as bifunctional alkylating agents of the formula $$\left[\mathrm{Cl}-(\mathrm{CH_2}-\underset{\underset{\mathrm{OH}}{|}}{\mathrm{CH}}-\mathrm{CH_2}-\overset{\overset{\mathrm{R}}{|}}{\underset{\underset{\mathrm{R}}{|}}{\mathrm{N}}}{}^{(+)})_x-\mathrm{CH_2}-\underset{\underset{\mathrm{OH}}{|}}{\mathrm{CH}}-\mathrm{CH_2}-\mathrm{Cl}\right]\ [\mathrm{Cl}^{(-)}]$$

prepared according to U.S. Pat. No. 3,632,559, Example 2,1.

Particularly preferred compounds B are dichloroethane and epichlorohyrin.

The build-up of the polyaminopolyamides C according to the invention is already known from the publications German Patent Specification Nos. 1,771,814 and 1,771,043.

Polyalkylenepolyamines D of the formula $$\mathrm{H_2N}-[\mathrm{CH_2}-\underset{\underset{\mathrm{R}}{|}}{\mathrm{CH}}-(\mathrm{CH_2})_y-\mathrm{NH}]_x-\mathrm{H},$$

in which

R denotes H or $CH_3$, the indices y are identical or different and denote the number 0 or 1 and x denotes 1 to 3 or 4 to 2,500, which may be mentioned are, above all, the polyethylenepolyamines, in which y represents zero, for example ethylenediamine, propylenediamine, diethylenetriamine, dipropylenetriamine, triethylenetetramine, tripropylenetetramine, tetraethylenepentamine, tetrapropylenepentamine, pentaethylenehexamine, pentapropylenehexamine, hexaethyleneheptamine, heptaethyleneoctamine, heptapropyleneoctamine and their mixtures, and polyethylenepolyamines which additionally also contain one or more piperazine rings, such as aminoethylpiperazine, pentaethylenepentamine, octaethyleneheptamine and mixtures thereof, but in particular (a) the polyethylenepolyamine mixture which is obtained in the batchwise (for example Houben-Weyl, 4th edition, XI/1, page 44) or continuous (for example in British Patent Specification Nos. 1,832,534 and 2,049,467) reaction of 1 mole of 1,2-dichloroethane with aqueous ammonia (6–30 moles), if appropriate in the presence of added ethylenediamine or diethylenetriamine (U.S. Pat. Nos. 2,769,841 and 3,484,488), and which contains considerable amounts of tetraethylenepentamine, pentaethylenehexamine, hexaethylenehexamine, hexaethyleneheptamine, heptaethyleneheptamine and higher amines, and, above all, (b) the polyethylenepolyamine mixtures, which remain after distilling off ethylenediamine, and if appropriate also diethylenetriamine and triethylenetetramine, from the base mixture prepared according to (a), (c) the polyfunctional oligomeric amines which can be prepared by condensation of 1,2-dichloroethane with the abovementioned polyethylenepolyamines, individually or as a mixture, and which have an average molecular weight of 1,000 to 10,000, in particular 2,000 to 5,000, and (d) the polyfunctional amines which can be obtained by polymerisation of 1,2-alkyleneimines and have an average molecular weight of 1,000 to 10,000, in particular 2,000 to 5,000.

Other polyalkylenepolyamines of the abovementioned formula which may also be mentioned are: (e) pure polypropylenepolyamines and mixtures thereof, (f) mixed polyethylenepolypropylenepolyamines and mixtures thereof, above all those which are obtained via single or several reactions between ethylenediamine and/or propylene-1,3-diamine and acrylonitrile, with subsequent hydrogenation in each case, for example polyfunctional amines of the formula $$\mathrm{H_2N}-[\mathrm{CH_2}-\mathrm{CH_2}-\mathrm{CH_2}-\mathrm{NH}]_x-\mathrm{H}$$

wherein x denotes an integer from 1 to 10, and those of the formula $$\mathrm{H}[\mathrm{NH}-\mathrm{CH_2}-\mathrm{CH_2}-\mathrm{CH_2}]_m-\mathrm{NH}-\mathrm{CH_2}-\mathrm{CH_2}-\mathrm{NH}-[\mathrm{CH_2}-\mathrm{CH_2}-\mathrm{CH_2}-\mathrm{NH}]_n\mathrm{H}$$

wherein m denotes an integer from 1 to 5 and n denotes an integer from 0 to 5, and also (g) the polyfunctional amines which can be prepared by condensation of 1,2-dichloroethane with the polyalkylenepolyamines mentioned under (e) and (f) and have an average molecular weight of 1,000 to 10,000, in particular 2,000 to 5,000.

In some cases, it is advantageous if a portion of the polyalkylenepolyamines D employed is replaced by other types of di-, tri-, tetra-, penta- or hexa-amines, for example by amines of the formula $$\mathrm{Y}-[(\mathrm{CH_2}-\underset{\underset{\mathrm{R^3}}{|}}{\mathrm{CH}}-\mathrm{CH_2}-\mathrm{NH})_p-\mathrm{H}]_q$$

in which

Y represents oxygen, sulphur or the radical, which is at least divalent, of an aliphatic, cycloaliphatic, araliphatic or aromatic compound containing hydroxyl and/or sulphhydryl groups, $R^3$ denotes hydrogen or the methyl group, p is an integer of at least 1, preferably 1–3, and q represents an integer of at least 2, preferably 2–4.

Examples of representatives of these polyamines are bis-(3-amino-propyl) ether, bis-(3-aminopropyl) sulphide, ethylene glycol bis-(3-amino-propyl) ether, dithioethylene glycol bis-(3-aminopropyl) ether, neopentylene glycol bis-(3-amino-propyl) ether, hexahydro-p-xylylene glycol bis-(3-amino-propyl) ether and hydroquinone bis-(3-amino-propyl) ether, and amines of the formula

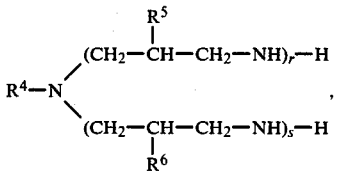

in which $R^4$ represents a $C_1$–$C_{18}$-alkyl radical which is optionally substituted by an amino or hydroxyl group, $R^5$ and $R^6$ independently of one another represent hydrogen or a methyl group and r and s are a number from 1 to 20, preferably 2 to 5.

The ratios of components A:C:D in the preparation of the nitrogen-containing condensation products contained in the agents according to the invention are: A: 20 to 100 parts by weight, preferably 40 to 80 parts by weight, C: 0 to 80 parts by weight, preferably 20 to 60 parts by weight, D: 0 to 80 parts by weight, preferably 20 to 60 parts by weight.

The weight ratios of the essential component B vary very greatly, depending on the nature and amount of A, C and D. As described above, component B is employed in an amount such that water-soluble polycondensates which have a viscosity of 100 to 1,000 mPa.s at 25° C. in 25 percent strength aqueous solution are formed.

The ratios of the polyfunctional compounds B to the other components A, C and D are advantageously chosen so that the amounts required for forming the desired degree of condensation of the water-soluble polycondensate are not substantially exceeded. The minimum amount to be used of compounds B which are polyfunctional towards amino groups in order to obtain reaction products with the desired high molecular weight or solutions thereof with the desired viscosity at 25° C. (that is to say 100–1,000 mPa.s, preferably 200–400 mPa.s, in a 25% strength aqueous solution) chiefly depends on the molecular weight of the components and can easily be determined from case to case by preliminary experiments.

It is important here that all the functional groups of the compounds B have reacted, so that the reaction product is virtually free from self-crosslinking groups.

The polycondensates can be prepared from the polyether-amines A and, if appropriate, the polyamide-amines C and/or the polyalkylenepolyamines D by processes which are known per se, for example by stirring mixtures of A and, if appropriate, C and/or D and the compounds B which are polyfunctional towards amino groups in aqueous media at pH values above 6 and at temperatures between 0 and 150° C. until a sample of the reaction mixture, in the form of a 10% strength aqueous solution at 250° C., has a viscosity of at least 10 mPa.s. It is frequently advantageous gradually to add the polyfunctional compounds to the mixture of A and/or C and/or D in the aqueous medium, under otherwise identical reaction conditions, until the desired viscosity is reached. The content of active products in the reaction solution, which is preferably between 10 and 30 percent by weight, is then adjusted to the desired end value by dilution with water, if the reaction has been carried out at a higher concentration. In some cases, when the desired viscosity has been reached, it is necessary to adjust the pH value of the reaction solution to pH 6, preferably to pH 4 to 5, by addition of acids, for example hydrochloric acid, sulphuric acid, phosphoric acid or acetic acid, to bring the action to completion. This particularly applies in the case where the amount of functional compounds has considerably exceeded the minimum amount required to form the desired degree of condensation of the water-soluble polycondensate.

The condensation can also be carried out in a closed vessel at temperatures above the boiling point of the compound B which is polyfunctional towards amino groups, and in particular, if dihalogenoalkanes are used, preferably at between 90°–150° C. under pressures of 0–50 bar, preferably 3 to 8 bar. In this case, it is not usually necessary to stop the reaction by adding acid.

The total concentration of the compounds in the aqueous reaction mixture should be 10 to 50 percent by weight.

In the preparation of the reaction products according to the invention, it is not absolutely essential for the reaction of the polyfunctional compound B to be carried out with a mixture of A and/or C and/or D. It is also possible first to react one of the three components A, C and D or combinations of two of these compounds with the polyfunctional compound B to give a precondensate and then to react this with the other component in a second stage.

The polycondensates are characterised by a minimum molecular weight of 2,500, preferably 5,000. The upper limit of the molecular weight is given by their property of being water-soluble. The upper limit of their molecular weight cannot be defined numerically, since it depends greatly on the polyamines on which they are based and the number of groups contained therein which confer water-solubility.

The polycondensates are used as auxiliaries for increasing the retention of fibres, fillers and pigments and as drainage accelerators by a procedure which is known per se, in which the polycondensates according to the invention are added in the form of dilute aqueous suspensions to the pulp suspension before the head box, the metering point being chosen so that good distribution of the auxiliary in the raw material suspension is ensured, but too long a contact time is avoided. The amounts of polycondensate required to achieve the desired retention action and/or drainage accelerating action can be determined without difficulty by preliminary experiments; in general, it is advisable to use 0.005 to 0.5 percent by weight of polycondensate, based on the dry weight of the paper. The addition of polyamines according to the invention before the head box of a paper machine also has an advantageous effect during working up of the effluents from the paper machine by filtration, flotation or sedimentation; the coagulating action of the polycondensates according to the invention very considerably facilitates the removal of pulp constituents from the effluent from the paper machine.

The polycondensates according to the invention can also be used as auxiliaries in the working up of effluents from paper machines by filtration, flotation or sedimentation by a procedure which is known per se, preferably by a procedure in which the reaction products in question are added in the form of dilute aqueous solutions to the effluent from the paper machine, advantageously before entry into the save-all.

PPO/glycol: polypropylene oxide started from glycol

DTRA: diethylenetriamine

AEP: aminoethylpiperazine

BAPMA: bis-aminopropylmethylamine

AEP-DTRA: mixture of aminoethylpiperazine and diethylenetriamine

AEP-DTRA-BAPMA: mixture of aminoethylpiperazine, diethylenetriamine and bis-aminopropylmethylamine.

| A | a | b | c | d | e | f | g | h | i | k | l | m | n | o |
|---|---|---|---|---|---|---|---|---|---|---|---|---|---|---|
| 1 | 215 | polyethylene glycol | 612 | 1.1 | 67.4 | 2.07 | 1.0 | 5 | 223 | 100 | 67 | DTRA | 3 | 120 |
| 2 | 215 | " | 612 | 1.1 | 67.4 | 2.07 | 1.0 | 5 | 223 | 100 | 84 | AEP | 3 | 120 |
| 3 | 215 | " | 612 | 1.1 | 67.4 | 2.07 | 1.0 | 5 | 223 | 100 | 94 | BAPMA | 3 | 120 |
| 4 | 120 | " | 400 | 1.0 | 69.4 | 2.50 | 1.0 | 5 | 113 | 100 | 90 | BAPMA | 4 | 100 |
| 5 | 500 | " | 1450 | 2.0 | 80.0 | 2.50 | 0.5 | 5 | 253 | 100 | 73 | BAPMA | 5 | 100 |
| 6 | 673 | PEO/TMP[1] | 673 | 2.0 | 192 | 2.07 | 1.5 | 2 | 150 | 100 | 51 | AEP—DTRA[2] | 5 | 100 |
| 7 | 337 | " | 673 | 1.5 | 128 | 2.75 | 1.0 | 2 | 150 | 100 | 68 | " | 5 | 100 |
| 8 | 673 | " | 673 | 2.0 | 208 | 2.25 | 1.0 | 3 | 150 | 100 | 54 | AEP—DTRA—BAPMA[3] | 3 | 120 |
| 9 | 268 | " | 306 | 1.0 | 182 | 2.25 | 1.0 | 2 | 150 | 100 | 84 | AEP—DTRA—BAPMA[3] | 5 | 100 |
| 10 | 127 | PPO/glycol[4] | 423 | 0.5 | 65 | 2.30 | 1.0 | 3 | 150 | 100 | 53 | DTRA | 5 | 100 |

[1]Polyethylene oxide started from trimethylolpropane.
[2]Weight ratio of AEP—DTRA = 10:1.
[3]Weight ratio of AEP/DTRA/BAPMA = 10:1:2.
[4]Polypropylene oxide started from glycol.

The amounts of polyamines which effect adequate coagulation of the pulp constituents contained in the paper machine effluents are to be chosen according to the composition of the effluents and can easily be determined from case to case by preliminary experiments; in general, amounts of 0.005 to 2 g of polyamine per $m^3$ of effluent are adequate for this purpose.

In comparison with similar known compounds, the condensates according to the invention exhibit an increase in the retention activity and in particular an acceleration in drainage when used in the range from pH 4.0 to 8.0.

In closed water circulation systems, the polycondensates according to the invention display a particularly low sensitivity towards enriched troublesome substances.

Some polycondensates according to the invention and their use for increasing the retention of fibres, fillers and pigments and for accelerating drainage in papermaking are described below.

EXAMPLES

Preparation of the polyglycol ether-amines A d parts of boron trifluoride-etherate were added to a parts of polyglycol ether of composition b and average molecular weight c, the mixture was heated to 70° C., e parts of ephichlorohydrin (f moles of epichlorohydrin per mole of polyglycol ether) were added at 70°-80° C. in the course of g hours and the mixture was stirred at 80° C. for h hours and then cooled.

i parts of this reaction product were stirred at k° C. into l parts of amine or amine mixture m and the mixture was stirred for a further n hours at o° C. It was then cooled to 90°-95° C. and diluted with water to a solids content of 50%.

The abbreviations mentioned below have the following meaning:

PEO/TMP: polyethylene oxide started from trimethylolpropane

A 11

2.0 parts of boron trifluoride-etherate were added to 673 parts by weight of PEO started from TMP, with a molecular weight of 673, the mixture was heated to 70° C., 208 parts by weight of epichlorohydrin were added at 70°-80° C. in the course of 1 hour and the mixture was stirred at 80° C. for a further 3 hours.

50 parts by weight of the reaction product were stirred with a mixture of 42 parts by weight of AEP, 4 parts by weight of DETA and 8 parts by weight of BAPMA at room temperature and the mixture was heated to 100° C. A further 100 parts by weight of the reaction product were then added at this temperature in the course of 1 hour and the mixture was subsequently stirred at 120° C. for a further 3 hours. After cooling to 90°-95° C., 204 parts by weight of water were stirred in with further cooling.

A 12

As described in A 11, 150 parts by weight of a reaction product of polyethylene glycol and epichlorohydrin were prepared and were cooled from 80 to 60° C. A mixture of 42 parts by weight of AEP, 4 parts by weight of DTRA and 8 parts by weight of BAPMA was stirred in at this temperature in the course of 1 hour. The mixture was then heated to 120° C. for 3 hours, cooled to 90°-95° C. and brought to a solids content of 50% by weight with water.

Polyamide-polyamine C 1

108 g (1.05 moles) of diethylenetriamine are mixed with 146 g (1 mole) of adipic acid, with the addition of 9 g (0.05 mole) of adipic acid dihydrazide, in a reaction vessel with a gas inlet tube and descending condenser, and the mixture is heated to 190° C. in the course of 3-4 hours, while stirring and passing over oxygen-free nitrogen, the reaction temperature being increased in the range from 150 to 190° C. at a rate such that the water formed distils off uniformly. After about 30 g of water and small amounts of diethylenetriamine have distilled over, the reaction mixture is stirred at 190°-180° C. under reduced pressure (20-50 mm Hg) until a total of 44 g of distillate are obtained, and is then cooled to 130°

C., and the same amount by weight (219 g) of water is added. The basic polyamide formed is thus obtained in the form of a 50% strength aqueous solution, which has a viscosity of 300–400 cP at 25° C. and an equivalent weight of 340.

Polyamide-polyamine C 2

108 g (1.05 moles) of diethylenetriamine, 146 g (1.0 mole) of adipic acid and 28 g (0.25 mole) of ε-caprolactam are reacted, with the addition of 9 g (0.05 mole) of adipic acid dihydrazide, as described in the preparation of reaction product C 1, to give the corresponding basic polyamide. The 50% strength polyamide solution obtained on addition of the same amount by weight of water has a viscosity of 400–500 cP at 25° C. and an equivalent weight of 400.

Condensation product 1

77.0 parts by weight of A 8 were stirred in 77.0 parts by weight of water, together with 2.8 parts by weight of epichlorohydrin, at 80° C. for 24 hours.

Solids content: 27.2% by weight

Viscosity at 25° C.: 208 mPa.s

Condensation product 2

85.0 parts by weight of C 1, and 40.0 parts by weight of A 8 were stirred in 129.0 parts by weight of water with 2.9 parts by weight of epichlorohydrin at 80° C. for 24 hours.

Solids content: 25.8% by weight

Viscosity at 25° C.: 361 mPa.s

Condensation product 3

75.0 parts by weight of A 3 were stirred in 75 parts by weight of water with 5.2 parts by weight of epichlorohydrin at 80° C. for 24 hours.

Solids content: 29.2% by weight

Viscosity at 25° C.: 200 mPa.s

Condensation product 4

54.0 parts by weight of A 4, 62 parts by weight of C 1 and 119 parts by weight of water were heated at 80° C. with 3.9 parts by weight of epichlorohydrin for 16 hours.

Solids content: 27.7% by weight

Viscosity at 25° C.: 459 mPa.s

Condensation product 5

54.0 parts by weight of A 4, 62.0 parts by weight of C 2 and 110 parts by weight of water were heated at 80° C. with 4.1 parts by weight of epichlorohydrin for 16 hours.

Solids content: 26.9% by weight

Viscosity at 25° C.: 12

Condensation product 6

200.0 parts by weight of A 8, 200 parts by weight of water and 12.0 parts by weight of dichloroethane were stirred at 80°–90° C. for 24 hours.

Solids content: 25.4% by weight

Viscosity at 25° C.: 355 mPa.s

Condensation product 7

200.0 parts by weight of A 8, 200 parts by weight of water and 14.0 parts by weight of dichloroethane were stirred at 125° C. in a pressure vessel for 6 hours.

Solids content: 25.8% by weight

Viscosity at 25° C.: 370 mPa.s

Condensation product 8

100.0 parts by weight of A 8, 100.0 parts by weight of C 1 and 200 parts of water were stirred together with 8.6 parts by weight of dichloroethane at 125° C. in a pressure vessel for 4 hours.

Solids content: 24.1% by weight

Viscosity at 25° C.: 337 mPa.s

USE EXAMPLE 1

Paper with a weight per unit area of about 80 g/m$^2$ was produced from 40% of bleached conifer sulphite pulp and 60% of bleached birch sulphate pulp on a laboratory paper machine (Kämmerer type). The paper was produced on the one hand in the acid range and on the other hand at neutral pH values.

(a) Acid range

Addition of 40% of China clay, as a filler, 1% of rosin size and 4% of aluminum sulphate to the pulp. The pH value was brought to 5.5 with sulphuric acid.

(b) Neutral range

Addition of 40% of chalk, as a filler, and 1% of Aquapel 360 XZ (synthetic size based on stearyl-diketene from Hercules Inc.) to the pulp. The pH value was brought to 7.5 with sodium hydroxide solution.

The 1% strength aqueous solutions of the condensation products 1 to 8 were metered in upstream of the head box of the paper machines by means of a metering pump. For comparison, 1% dilutions of the known retention agent I according to Example 1 of German Patent Specification 1,771,814 and of the known retention agent II according to Example 1 of German Offenlegungsschrift No. 2,736,651, and of the known retention agent III (U.S. Pat. No. 3,972,939, Example 1) were likewise metered in.

The solids content in the effluent from the paper machine was determined as a measure of the retention action. The lower this solids content, the better the retention action.

Table 2 which follows shows that the polyamines according to the invention have a very good retention action both in the acid and in the neutral range, and that this action is better than that obtained using the known retention agents. The amounts added in each case relate to the weight of the air-dried pulp and to the 25% strength solution of the retention agent.

TABLE 2

| Retention agent | Amount added % | Dry residue in the effluent, mg/liter pH 5.5 | pH 7.5 |
|---|---|---|---|
| none | — | 850 | 1185 |
| condensation product 1 | 0.1 | 315 | 350 |
| condensation product 2 | 0.1 | 315 | 340 |
| condensation product 3 | 0.1 | 320 | 350 |
| condensation product 4 | 0.1 | 315 | 345 |
| condensation product 5 | 0.1 | 325 | 350 |
| condensation product 6 | 0.1 | 320 | 340 |
| condensation product 7 | 0.1 | 320 | 345 |
| condensation product 8 | 0.1 | 320 | 345 |
| I | 0.1 | 355 | 385 |
| II | 0.1 | 335 | 380 |
| III | 0.1 | 330 | 385 |

USE EXAMPLE 2

The so-called drainage time was determined as a measure of the drainage acceleration to be expected on a paper machine. This is determined by measuring the time taken, in a Schopper-Riegler freeness tester, for a particular freeness or volume of water in the collecting glass to be established. The shorter the time, the better the drainage acceleration which can be achieved.

A pulp mixture of waste paper and 10% of clay was beaten using a high-speed stirrer and the pH value was adjusted:

(a) Acid range:

Addition of 0.5% of aluminium sulphate, pH adjusted to 4.5 with sulphuric acid.

(b) Neutral range:

pH adjusted with 7.0 with sodium hydroxide solution.

200 ml of the 1% strength pulp suspension prepared according to (a) or (b) were made up in each case to 1,000 ml in series A with fresh water and in series B with a circulation water (closed circulation, fresh water requirement 10–12 liters/kg of paper, overall hardness of 27° German hardness, 2,480 mg of evaporation residue/liter, 1,140 mg of $O_2$/liter COD value), and the drainage time was determined with the aid of the Schopper-Riegler apparatus.

The amounts added in each case relate to the weight of the air-dried pulp and to the 25% strength solution of the condensation products 1 to 8.

The following Table 3 illustrates the good drainage effect of the polyalkylenepolyamines according to the invention both in the acid and in the neutral range. For comparison, the known retention agents listed in Use Example 1 were likewise metered in.

TABLE 3

| Condensation product | Amount added in % | Drainage acceleration on waste paper, 10% of clay and 0.5% of alum: Drainage time at 60° SR in seconds (pH 4.5) A | B | Drainage time at 60° SR in seconds (pH 7) A | B |
|---|---|---|---|---|---|
| — | | 111 | 122 | 140 | 136 |
| 1 | 0.2 | 61 | 84 | 63 | 88 |
| 2 | 0.2 | 64 | 89 | 65 | 89 |
| 3 | 0.2 | 68 | 90 | 68 | 89 |
| 4 | 0.2 | 60 | 84 | 62 | 86 |
| 5 | 0.2 | 62 | 86 | 64 | 88 |
| 6 | 0.2 | 61 | 85 | 62 | 85 |
| 7 | 0.2 | 60 | 83 | 62 | 85 |
| 8 | 0.2 | 57 | 82 | 62 | 86 |
| I | 0.2 | 68 | 95 | 70 | 98 |
| II | 0.2 | 68 | 97 | 69 | 98 |
| III | 0.2 | 72 | 104 | 68 | 107 |

We claim:

1. In a condensation product suitable for increasing the retention of fibers, fillers and pigments and for accelerating drainage in papermaking, and as flocculating agents in the working up of effluents from papermaking by filtration, sedimentation and flotation, the condensation product being obtained by reacting (A) an aliphatic polyol-ether-amine and (B) a compound which is polyfunctional toward amino groups, the improvement wherein (A) is an aliphatic polyol-ether-amine which is free from halogen groups, contains cohesive polyether segments and carries no amino groups within these segments, and which is obtained by reaction of an ω-polychloropolyolether with a functionality of 1.90–3.10 moles of Cl/mole, with at least one compound selected from the group consisting of (a) a polyalkylenepolyamine of the formula

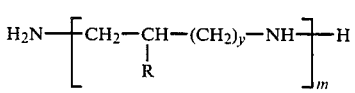

in which

R is H or $CH_3$, y is 0 or 1, and m is from 1 to 50, (b) a polyalkylenepolyamine of the formula

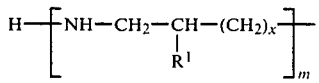

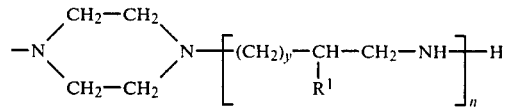

in which $R^1$ is H or $CH_3$, x and y each independently is 0 or 1, m is from 1 to 50, and n is from 0 to 50, (c) a polyalkylenpolyamine of the formula

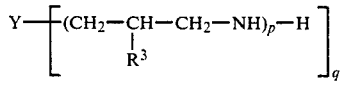

in which

Y is oxygen, sulphur, or an at least divalent radical of an aliphatic, cycloaliphatic, araliphatic, or aromatic compound containing at least one member selected from the group consisting of a hydroxyl and sulphhydryl radical, $R^3$ is hydrogen or $CH_3$, p is at least 1, and q is at least 2, and (d) an amine of the formula

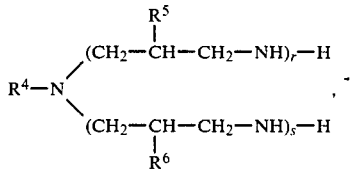

in which $R^4$ is a $C_{1-C18}$-alkyl radical which is unsubstituted or substituted by an amino or hydroxyl group, $R^5$ and $R^6$ each independently is hydrogen or a methyl group and r and s each independently is from 1 to 20, and (B) is a compound selected from the group consisting of an α,ω-alkyldihalide, halogenhydrin, epihalogenohydrins, bis-epoxy-compound, chloroformic acid ester, glycidylether of polyalkylene oxide and a bifunctional alkylating agent of the formula

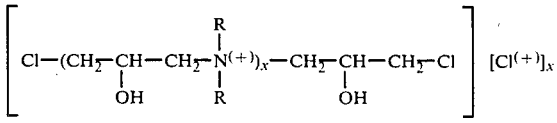

in which

R is H or $CH_3$, and

X is 1 to 3, and (B) is employed in an amount such that the condensation product is water-soluble and in 25 percent strength aqueous solution at 25° C. has a viscosity of 100 to 1,000 mPa.s.

2. A condensation product according to claim 1, wherein the halogen-free aliphatic poly-ether-amine (A) is obtained at a temperature of 80° to 200° C. without the addition of a solvent.

3. A condensation product according to claim 1, wherein the reaction between (A) and (B) is effected in the presence of at least one member selected from the group consisting of (C) a polyaminopolyamide obtained from 1 molar portion of a dicarboxylic acid with 4 to 10 carbon atoms and 0.8 to 1.4 molar portions of a polyalkylenepolyamine with 3 to 10 alkyleneimine units, and (D) a polyalkylenepolyamine of the formula $$H_2N-[CH_2-\underset{\underset{R}{|}}{CH}-(CH_2)_y-NH]_x-H$$

in which

R is H or $CH_3$, y is 0 or 1, and x is from 4 to 2,500.

4. A condensation product according to claim 1, wherein the ω-polychloropolyol-ether (ω) is an addition product of a polyol-ether and epichlorohydrin.

5. A condensation product according to claim 1, wherein (A) is obtained by reacting an aliphatic polyol-ether-amine with a polyalkylenepolyamine (a), (a) being obtained by reacting an addition compound of a polyether with at least 2 OH groups and an average molecular weight of 200 to 1,200 and epichlorohydrin.

6. A condensation product according to claim 1, wherein (A) is obtained by reacting an ω-polychloropolyolether with a functionality of 1.9–3.1 moles of Cl/mole with (a) which is a polyalkylenepolyamine mixture which contains at least 60 mole % of N-aminoethylpiperazine and less than 20 mole % of diethylenetriamine.

7. A condensation product according to claim 1 wherein (B) is at least one member selected from the group consisting of dichloroethane and epichlorohydrin.

* * * * *